US005730373A

United States Patent [19]

Tamura et al.

[11] Patent Number: 5,730,373

[45] Date of Patent: Mar. 24, 1998

[54] CRUSHER SYSTEM DRIVE CONTROL APPARATUS FOR A TRAVELING TYPE CRUSHING MACHINE

[75] Inventors: Yukio Tamura; Yasutaka Nishida; Masaho Yamaguchi; Motoki Kurohara; Toru Nakayama, all of Kawasaki, Japan

[73] Assignee: Komatsu Ltd., Tokyo, Japan

[21] Appl. No.: 663,196

[22] PCT Filed: Dec. 27, 1994

[86] PCT No.: PCT/JP94/02273

§ 371 Date: Jun. 13, 1996

§ 102(e) Date: Jun. 13, 1996

[87] PCT Pub. No.: WO95/17969

PCT Pub. Date: Jul. 6, 1995

[30] Foreign Application Priority Data

Dec. 28, 1993 [JP] Japan ..... 5-334010
Dec. 28, 1993 [JP] Japan ..... 5-334125

[51] Int. Cl.[6] ..... B02C 25/00

[52] U.S. Cl. ..... 241/34; 241/36; 241/101.74

[58] Field of Search ..... 241/34, 36, 37, 241/101.74

[56] References Cited

U.S. PATENT DOCUMENTS 4,721,257 1/1988 Williams et al. ..... 241/36
4,793,561 12/1988 Burda ..... 241/36
4,988,045 1/1991 Griesedieck et al. ..... 241/36
5,074,435 12/1991 Suverkrop et al. ..... 241/34
5,566,893 10/1996 Getz ..... 241/34

FOREIGN PATENT DOCUMENTS 64-32744 3/1989 Japan .
4-4029 1/1992 Japan .
4-210258 7/1992 Japan .
5-154405 6/1993 Japan .

*Primary Examiner*—Mark Rosenbaum
*Attorney, Agent, or Firm*—Frishauf, Holtz, Goodman, Langer & Chick

[57] ABSTRACT

There is provided a crusher system drive control apparatus for a traveling type crushing machine including a vehicle body that is equipped with a traveling body and that has mounted thereon a crusher system including a feeder, a crusher and a belt conveyer, which drive control apparatus comprises an abnormal condition detecting means for sensing an abnormal stop of the said belt conveyer, and an operation terminating means in response to a detection signal that is output by the said abnormal condition detecting means for stopping an operation of each of the said feeder and the said crusher.

15 Claims, 5 Drawing Sheets

CRUSHER SYSTEM DRIVE CONTROL APPARATUS FOR A TRAVELING TYPE CRUSHING MACHINE

BACKGROUND

The present invention relates to an apparatus for the drive control of a crusher system which comprises a feeder, a crusher, a belt conveyer and so forth in a traveling type crushing machine that is designed to crush wooden bodies, concrete blocks and so forth which are produced, e.g., when a building is broken.

BACKGROUND ART

A self traveling type crushing machine has been known, as disclosed, e.g., in Japanese Unexamined Utility Model Publication No. Sho 64-32744, which has a vehicle body that is equipped with a traveling body and that has mounted thereon a hopper, a crusher and a conveyer and in which those objects which are thrown into the hopper are crushed by the crusher, the crushed pieces being conveyed on the conveyer and discharged out of the vehicle body.

Such a self traveling crushing machine may be provided with a feeder for feeding objects to be crushed thrown into the hopper automatically into the crusher. In such system, the feeder, the crusher and the belt conveyer are driven by drive sources which are operated independently of each other, each of these drive sources being then independently controlledly driven by a feeder switch, a crusher switch and a belt conveyer switch which are separate from each other.

Such a drive control apparatus is required to operate each of the switches where it is desired to stop the feeder, the crusher and the belt conveyer. If the belt conveyer removing the crushed objects is abnormally stopped, the crusher and the feeder will not be stopped but continue to be driven. Hence the objects to be crushed remain to be crushed. This have caused the crushed pieces to accumulate on the conveyer and may have caused the conveyer to be broken. When this happens, a time consuming repairing work has been required. Thus, the prior art has been found problematical in that a crushing operation tends to be extremely lowered in its efficiency.

Also, a crusher that is employed in the above mentioned self traveling type crushing machine is typically provided in a housing with a fixed jaw and a swinging jaw where the swinging jaw is swingingly reciprocated in the direction of the fixed jaw, thereby crushing objects to be crushed. Such a crusher is adequate in order to crush such common things as wooden bodies, concrete blocks and so forth as produced when a building is broken, but has been found to be unsatisfactory in dealing with large and high-strength materials such as fragments of a reinforcing steel and large wooden wastes. Such objects if charged into the hopper will get locked in between the fixed and swinging jaws to make the crusher inoperative.

If in this way an object to be crushed is firmly interlocked between the fixed and swinging jaws and as a result the crusher is stopped, the crusher will then be stopped in a state in which the swinging jaw is displaced proximate to the fixed jaw. Thus, an extremely large force is required in removing such an interlocked object, such removing operations become extremely laborious and a time consuming operation is required for removal of such an interlocked object. Thus, here again, a crushing operation tends to be extremely lowered in its efficiency.

Especially in the case of a traveling type crushing machine in which at the outlet of the crusher there are disposed traveling bodies, a belt conveyer and so forth, there remains a minimum space for removal below the crusher and it entails quite a troublesome job in the removal of an interlocked object. For this reason, a time consuming work is needed for removing an interlocked object. Hence, the prior art crushing operation has, here again, been found to be problematical since it tends to be extremely inefficient.

THE INVENTION

The present invention has as an object to obviate these inconveniences in the prior art and to provide a crusher system drive control apparatus for a traveling type crushing machine, which apparatus is capable of eliminating a possible damage of a belt conveyer, facilitates the removal of an object if it happens to be interlocked in the crusher, and permits a crushing operation to be carried out efficiently.

Briefly, in accordance with the present invention, in a first general form of embodiment thereof, a crusher system drive control apparatus for a traveling type crushing machine including a vehicle body that is equipped with a traveling body and that has mounted thereon a crusher system including a feeder, a crusher and a belt conveyer, which apparatus comprises: an abnormal condition detecting means for sensing an abnormal stoppage of the said belt conveyer; and an operation terminating means in response to a detection signal that is put out by the said abnormal condition detecting means for stopping an operation of each of the said feeder and the said crusher.

According to this construction, it can be seen that by virtue of the fact that when a belt conveyer is stopped for some abnormal reason, the operation of all others of the system units is caused to halt, there will develop no accumulation of the pieces crushed on the conveyer, thereby preventing the conveyer belt from being damaged.

In addition to the construction mentioned above, it should be noted that the apparatus preferably comprises: a feeder switching valve for delivering a pressure fluid to a feeder driving hydraulic motor; a crusher switching valve for delivering a pressure fluid to a crusher driving hydraulic motor; a belt conveyer switching valve for delivering a pressure fluid to a belt conveyer driving hydraulic motor; the said abnormal condition detecting means comprising a pressure switch that is responsive to the delivered fluid pressure to the said belt conveyer driving hydraulic motor that exceeds a predetermined pressure value; and the said operation terminating means comprising an electric circuit that is responsive to a detection signal which is output by the said pressure switch for driving each of the said switching valves to a pressure fluid delivery stop position.

Also, the said electric circuit should preferably comprise: a switch means that is connected to each of the said switching valves and is responsive to an electrical signal furnished thereto for switching the said each switching valve to one of a pressure fluid delivery position and a said pressure fluid delivery stop position, a feeder relay connected to a said switch means for the said feeder switching valve, a feeder switch for driving the said feeder relay, a crusher relay connected to a said switch means for the said crusher switching valve, a crusher switch for driving the said crusher relay, a belt conveyer relay connected to a said switch means for the said belt conveyer switching valve, a belt conveyer switch for driving the said belt conveyer relay, and an abnormal condition operative switch which is normally held on and arranged at a circuit that connects a self hold contact of each of the said relays with a power supply, whereby the said detection signal from the said pressure switch acts on the said abnormal condition operative switch so as to turn it off.

Also, it is preferred that an emergency stop switch be connected in series with the said abnormal condition operative switch in a circuit that connects the said self hold contact of a said relay with the said power supply.

Further, it is preferable that each of the said switch means for said said feeder switching valve and said switch means for said belt conveyer switching valve comprises a solenoid, and that the said switch means for the said crusher switching valve comprise a pilot valve that is adapted to be driven with the said solenoid.

The present invention also provides, in a second general form of embodiment thereof, a crusher system drive control apparatus for a traveling type crushing machine including a vehicle body that is equipped with a traveling body and that has mounted thereon a crusher system including a crusher and a belt conveyer, in which the said crusher is constituted by a fixed jaw and a movable jaw that is reciprocatable towards and away from the said fixed jaw by means of a crusher driving hydraulic motor, in which: a crusher switching valve for delivering a pressure fluid to the said crusher driving hydraulic motor is adapted to be switched from its neutral position alternatively to a normally rotary position and a reversely rotary position by a pilot valve which is driven by a first solenoid and a second solenoid, respectively; and a switch is provided between a power supply and the said second solenoid that is adapted to switch the said pilot valve to a position that is in turn adapted to drive the said crusher switching valve to the said reversely rotary position.

According to this construction, by virtue of the fact that since the said crusher driving hydraulic motor is reversely rotated only while the above mentioned switch is actuated, it can be seen that setting the time of actuation of the said switch at a short period of time will enable the said crusher driving hydraulic motor to be rotated in a reverse direction for a limited time and hence will enable the said movable jaw of the said crusher to be displaced by a short distance away from the said fixed jaw, thereby permitting an interlocked object to be removed easily.

In addition to the construction mentioned above, it should be noted that a timer is preferably interposed between the said switch and the said second solenoid.

The present invention also provides, in a third general form of embodiment thereof, a crusher system drive control apparatus for a traveling type crushing machine including a vehicle body that is equipped with a traveling body and that has mounted thereon a crusher system including a feeder, a crusher and a belt conveyer, in which the said crusher is constituted by a fixed jaw and a movable jaw that is reciprocatable towards and away from the said fixed jaw by means of a crusher driving hydraulic motor, which apparatus comprises: an abnormal condition detecting means for sensing an abnormal stop of the said belt conveyer; and an operation terminating means in response to a detection signal that is output by the said abnormal condition detecting means for stopping an operation of each of the said feeder and the said crusher, and in which apparatus, a crusher switching valve for delivering a pressure fluid to the said crusher driving hydraulic motor is adapted to be switched from its neutral position alternatively to a normally rotary position and a reversely rotary position by a pilot valve which is driven by a first solenoid and a second solenoid, respectively; and a switch is provided between a power supply and the said second solenoid that is adapted to switch the said pilot valve to a position that is in turn adapted to drive the said crusher switching valve to the said reversely rotary position.

In addition to the construction mentioned above, it should be noted that the drive control apparatus preferably further comprises: a feeder switching valve for delivering a pressure fluid to a feeder driving hydraulic motor; and a belt conveyer switching valve for delivering a pressure fluid to a belt conveyer driving hydraulic motor, in which preferable apparatus, the said abnormal condition detecting means comprises a pressure switch that is responsive to the delivered fluid pressure to the said belt conveyer driving hydraulic motor that exceeds a predetermined pressure value; and the said operation terminating means comprises an electric circuit that is responsive to a detection signal which is output by the said pressure switch for driving each of the said switching valves to a pressure fluid delivery stop position.

Also, it is preferred that the said electrical circuit comprise: a switch means that is connected to each of the said switching valves and is responsive to an electrical signal furnished thereto for switching the said each switching valve to one of a pressure fluid delivery position and a said pressure fluid delivery stop position, a feeder relay connected to a said switch means for the said feeder switching valve, a feeder switch for driving the said feeder relay, a crusher relay connected to a said switch means for the said crusher switching valve, a crusher switch for driving the said crusher relay, a belt conveyer relay connected to a said switch means for the said belt conveyer switching valve, a belt conveyer switch for driving the said belt conveyer relay, and an abnormal condition operative switch which is normally held on and arranged at a circuit that connects a self hold contact of each of the said relays with a power supply, whereby the said detection signal from the said pressure switch acts on the said abnormal condition operative switch so as to turn it off.

Also, it is preferable that an emergency stop switch be connected in series with the said abnormal condition operative switch in a circuit that connects the said self hold contact of a said relay with the said power supply.

Also, it is desirable that each of the said switch means for the said feeder switching valve and the said switch means for the said belt conveyer switching valve comprise a solenoid, and that the said switch means for the said crusher switching valve comprise a pilot valve.

Further, it is preferred that a timer is provided between the said switch and the said second solenoid.

BRIEF EXPLANATION OF THE DRAWINGS

The present invention will better be understood from the following detailed description and the drawings attached hereto showing certain illustrative embodiments of the present invention. In this connection, it should be noted that such embodiments as illustrated in the accompanying drawings are intended in no way to limit the present invention, but to facilitate an explanation and understanding thereof.

In the accompanying drawings.

DETAILED DESCRIPTION AND BEST MODES FOR CARRYING OUT THE INVENTION

Hereinafter, suitable embodiments of the present invention with respect to a crusher system drive control apparatus for a traveling type crushing machine will be set forth with reference to the accompanying drawings hereof.

Figure 1:
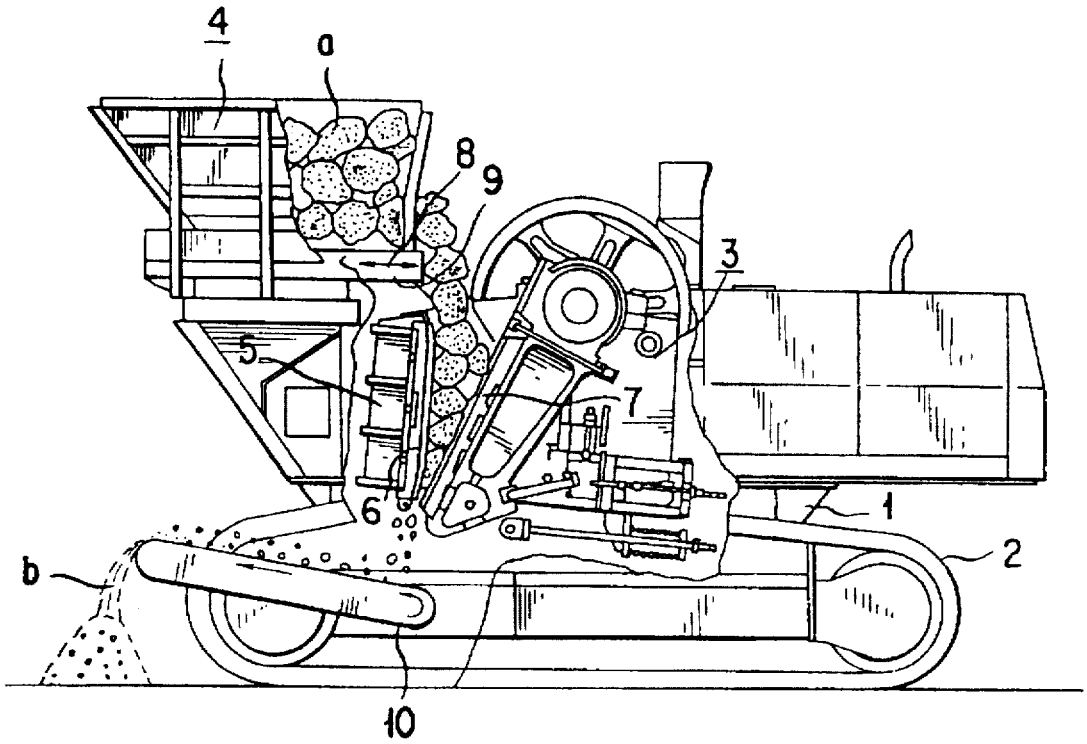
FIG. 1 is an entire diagrammatic view illustrating a traveling type crushing machine including a certain embodiment of the crusher system drive control apparatus according to the present invention.

As shown in FIG. 1, a traveling type crushing machine includes a vehicle body 1. This vehicle body 1 has mounted thereto at both lower left hand side and lower right hand side a pair of traveling bodies 2, and has a crusher 3 and a hopper 4 mounted thereon. The said crusher 3 is provided in a housing 5 with a fixed jaw 6 and a swing jaw 7 so that by swingingly reciprocating the said swing jaw 7 towards and away from the said fixed jaw 6, crushing of objects a to be crushed may be effected between it and the said fixed jaw 6. The said hopper 4 is equipped with a movable bottom plate 9 which constitutes a feeder 8 so that when the movable bottom plate 9 is reciprocated the objects to be crushed a may be fed into the said crusher 3. Between the said pair of traveling bodies 2 on the above mentioned vehicle body 1 there is mounted a belt conveyer 10 which is arranged to discharge the crushed pieces b out of the vehicle body 1.

Figure 2:
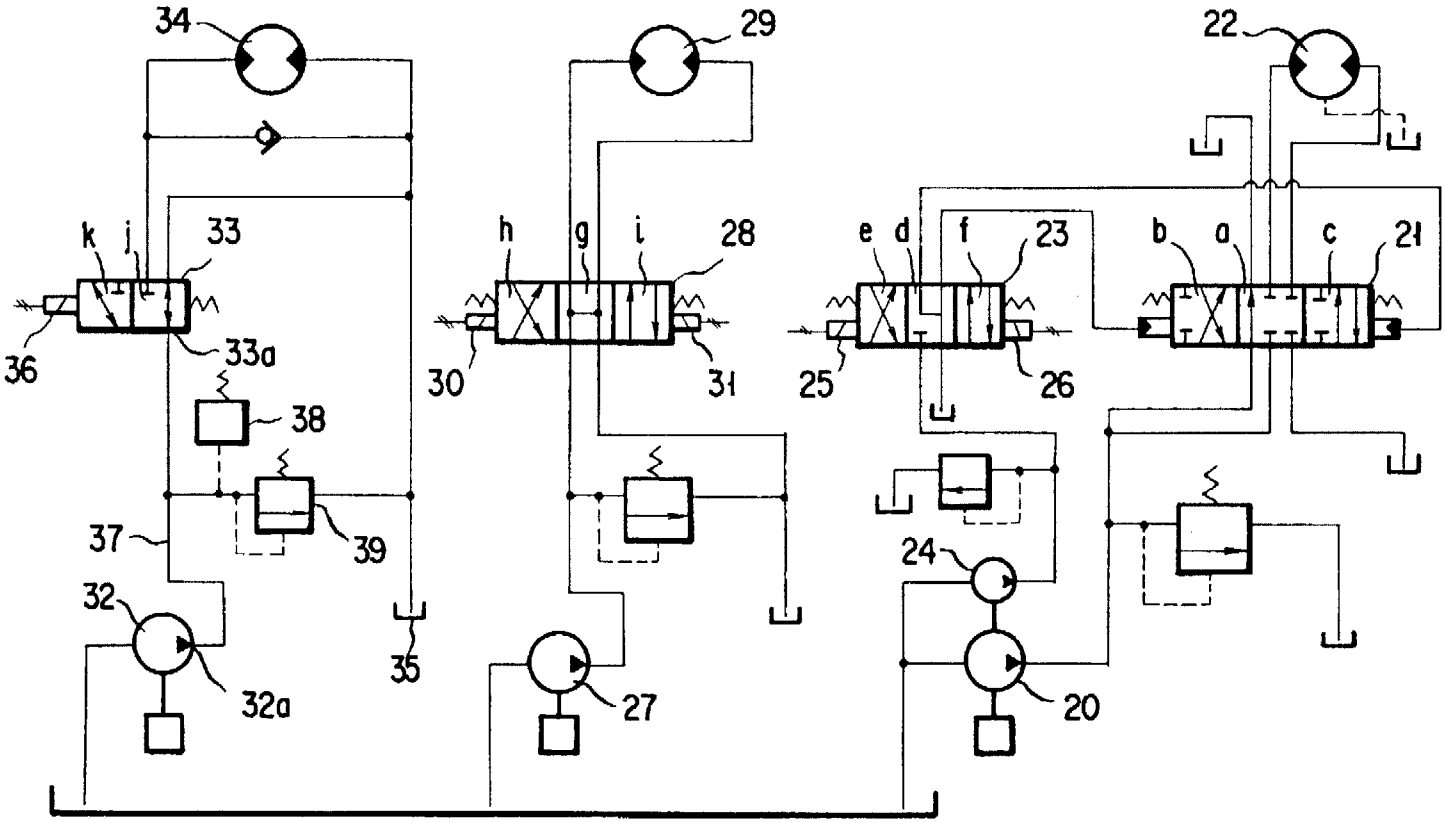
FIG. 2 is a circuit diagram illustrating a hydraulic circuit for controlledly driving a feeder, a crusher and a belt conveyer, constituting a portion of the above mentioned embodiment of the present invention.

FIG. 2 shows a hydraulic circuit of a certain embodiment of the crusher system drive control apparatus according to the present invention. A pressurized discharge fluid of a first primary hydraulic pump 20 is designed to be controlledly delivered to a crusher driving hydraulic motor 22 via a crusher switching valve 21. The said crusher switching valve 21 is normally held at its neutral position a and is adapted to be switched to a normally rotary position b and a reversely rotary position c under a pressurized discharge fluid of an auxiliary hydraulic pump 24 that is supplied from a pilot valve 23. The said pilot valve 23 is normally held at its neutral position and is adapted to be switched to a normally rotary position e and a reversely rotary position f if a first solenoid 25 and a second solenoid 26 are electrically energized, respectively.

A pressurized discharge fluid of a second primary hydraulic pump 27 is designed to be controlledly delivered to a feeder driving hydraulic motor 29 via a feeder switching valve 28. The said feeder switching valve 28 is normally held at its neutral position g and is adapted to be switched to a normally rotary position h and a reversely rotary position i if a first solenoid 30 and a second solenoid 31 are electrically energized, respectively.

A pressurized discharge fluid of a third primary hydraulic pump 32 is designed to be controlledly delivered to a belt conveyer driving hydraulic motor 34 and a reservoir 35 via a belt conveyer switching valve 33. The said belt conveyer switching valve 33 is normally held at its drain position i and is adapted to be switched to its supply position k when a solenoid 36 is electrically energized. A circuit 37 defined between an inlet port 33*a* of the said conveyer switching valve 33 and a discharge port 32*a* of the said primary pump 32 is provided therein with a pressure switch 38 that is adapted to be turned on when the discharge pressure of the said third primary hydraulic pump 32 is in excess of a set pressure at a relief valve 39.

Figure 3:
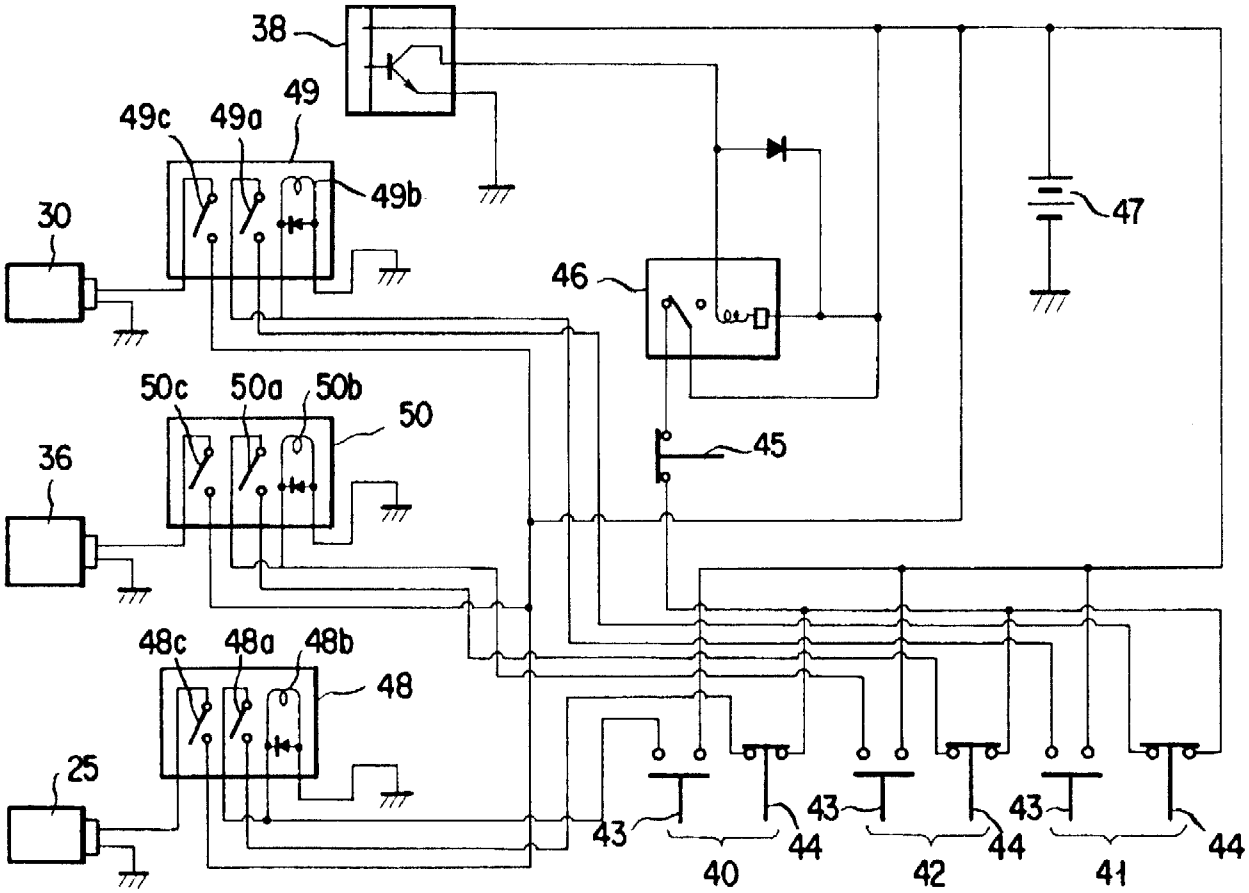
FIG. 3 is a circuit diagram illustrating an electric circuit for controlledly driving a feeder, a crusher and a belt conveyer, constituting a portion of the above mentioned embodiment of the present invention.

In FIG. 3 there is shown an electrical circuit diagram. In this electric circuit, a crusher switch 40, a feeder switch 41 and a belt conveyer switch 42 are each provided with a startup switch 43 and a stop switch 44 that is normally held on. The said stop switches 44 are connected in series with each other and are also connected via an emergency stop switch 45 and an abnormal condition operative switch 46 with a power supply 47. At the same time, each of the said stop switches 44 is connected via a self hold contact 48*a* of a crusher relay 48 with a coil 48*b*, is connected via a self hold contact 49*a* of a feeder relay 49 with a coil 49*b* and is connected via a self hold contact 50*a* of a belt conveyer relay 50 with a coil 50*b*.

A normally open contact 48*c* of the above mentioned crusher relay 48 is connected to the said first solenoid 25 of the above mentioned pilot valve 23. A normally open contact 49*c* of the above mentioned feeder relay 49 is connected to the said first solenoid 30 of the above mentioned feeder switching valve 28, and a normally open contact 50*c* of the above mentioned belt conveyer relay 50 is connected to the said solenoid 36 and the above mentioned belt conveyer switching valve 33.

The above mentioned emergency stop switch 45 is normally held on whereas the above mentioned abnormal condition operative switch 48 is normally held ON and will be turned OFF a predetermined time after the above mentioned pressure switch 38 is turned ON.

According to this circuit, it should be noted that when neither the said second solenoid 26 of the above mentioned pilot valve 23 or the said second solenoid 31 of the above mentioned feeder switching valve 28 is electrically energized, the said crusher hydraulic motor 22 and the feeder hydraulic motor 29 each require only a normal rotation; hence neither the said second solenoid 26 of the pilot valve 23 or the said second solenoid 31 of the feeder switching valve 28 neither needs to be electrically energized.

OPERATION

An explanation will now be given with respect to the operation of the arrangement previously set forth.

When the said startup switch 43 for the said crusher 40 is turned on, it can be seen that the said coil 48*b* of the said crusher relay 48 will be electrically energized to turn on the said self hold contact 48*a*, thus permitting the said coil 48*b* to be connected via the said self hold contact 48*a*, the said stop switch 44, the said emergency stop switch 45 and the said abnormal condition operative switch 46 to the said power supply 47. This will cause the said normally open contact 48*c* to remain on even if the said startup switch 43 is turned off. Thus, the said crusher relay 48 will have a self hold function.

This will in turn cause the said pilot valve 23 to be switched to its normally rotary position e and the said crusher switching valve 21 to take its normally rotary position b, thus permitting the pressurized discharge fluid of the said first primary hydraulic motor 20 to be delivered to the said crusher purpose hydraulic motor 22, thereby causing the latter to be rotationally driven normally to operate the said crusher 3 to perform a crushing operation.

Now, if the said stop switch 44 is turned off in the above mentioned state, the communication between the said coil 48*b* and the said power supply 47 will be blocked, thus turning the said normally open contact 48*c* off to switch the said pilot valve 23 to its neutral position d. This will cause the said crusher switching valve 21 to be switched to its neutral position a to stop the operation of the crusher driving hydraulic motor 22. Thus, the crusher 3 will then be stopped.

Also, when the said startup switch 43 for the said feeder switch 41 and the said startup switch 43 for the said belt conveyer switch 43 are turned on, the said feeder relay 49 and the said belt conveyer relay 50 will be operated in a similar manner to that as mentioned previously to rotationally drive the said feeder driving hydraulic motor 29 and the said belt conveyer driving hydraulic motor 34 each in a normal direction so as to drive the said feeder and the said belt conveyer 10. Thus, it can be apparent that both the said feeder relay 49 and the said belt conveyer relay 50, too, will each have a self hold function. When the said stop switch 44 is turned off in this state, the said feeder and the belt conveyer 10 will be stopped each in a similar manner to that as mentioned previously.

Further, if the said emergency stop switch 45 is turned off while the said feeder and the said belt conveyer 10 are both being operated as mentioned above, the self hold function will be removed on each of the said relay, thus bringing each of the switching valves to its neutral position. As a result, the said crusher 3, the said feeder and the said belt conveyer 10 will be emergency stopped substantially at the same time.

Also, as mentioned above, it can thus be seen that when some abnormality happens in the belt conveyer 10 so as to cause it to be stopped while the crusher 3, the feeder and the belt conveyer 10 are being operated to crush objects a to be crushed and while the crushed pieces b are being discharged with the conveyer belt 10, the belt conveyer driving hydraulic motor 34 will be stopped and, since the pressurized discharge fluid of the said third primary hydraulic pump 32 then loses its route to advance, an elevated pressure will thereby be generated at it. Then, when the pressurized discharge fluid of the said third primary hydraulic pump 32 becomes in excess of a preset pressure at the said relief valve 39, the said pressure switch 38 will be turned on.

If the said pressure switch 38 is turned on, it can be noted that the said abnormal condition operative switch 46 in FIG. 3 will be turned off a predetermined time thereafter. Then, the said self hold function will be removed on each relay and each switching valve will be turned to its neutral position to terminate its respective hydraulic motor. As a consequence, the said crusher 3, the said feeder and the said belt conveyer 10 will be stopped.

In this way, by virtue of the fact that when a belt conveyer 10 is stopped for some abnormality or the like reason, the operation of all others of the crusher system units is caused to halt, it can be seen that there will develop no accumulation of the pieces crushed on the conveyer 10, thereby preventing the conveyer belt from being damaged. Accordingly, any damage that is otherwise possible will be eliminated and a crushing operation can be carried out satisfactorily and with efficiency.

At this point it may be noted that a switch which can be turned on and off by a remote control or a radio control can be incorporated in a circuit that connects the the said self hold contact of each relay as mentioned above to the said power supply 47.

Figure 4:
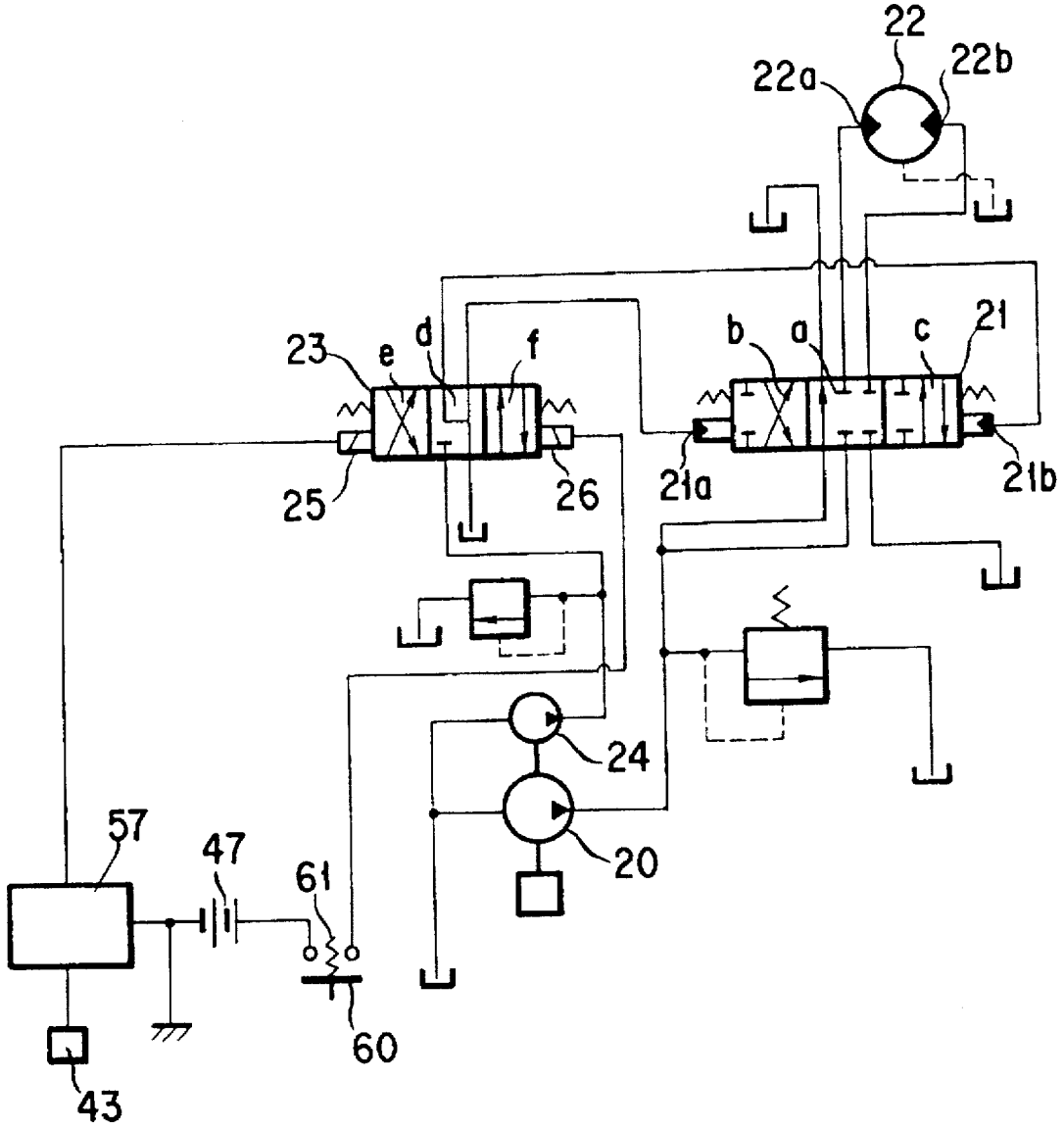
FIG. 4 is a circuit diagram illustrating another crusher drive control hydraulic circuit for the above mentioned embodiment of the present invention.

FIG. 4 shows another crusher drive control hydraulic circuit according to the present invention. A pressurized discharge fluid of a primary hydraulic pump 20 is designed to be controlledly delivered to a crusher driving hydraulic motor 22 via a crusher switching valve 21. The said crusher switching valve 21 is normally held at its neutral position a and is adapted to be switched to a normally rotary position b and a reversely rotary position c each with a pressurized discharge fluid of an auxiliary hydraulic pump 24 that is supplied from a pilot valve 23. The said pilot valve 23 is normally held at its neutral position and is adapted to be switched to a normally rotary position e and a reversely rotary position f if a first solenoid 25 and a second solenoid 26 are electrically energized, respectively.

The above mentioned first solenoid 25 is connected to a power supply 47 via a relay 57 which is controlled by an actuating switch 43 whereas the above mentioned second solenoid 26 is connected to the said power supply 47 via a push bottom switch 20 which is normally biased off by a spring 61. The said switch 60 is adapted to be turned on by pushing it against the said spring 61.

An explanation will now be given with respect to the operation of this crusher drive control hydraulic circuit.

The said relay 57 will be turned on by operating the said actuating switch 43 to electrically energize the said first solenoid 25 which will then act to switch the said pilot valve 23 to the normally rotary position e. Then, the said crusher switching valve 21 will, supplied with the pressurized discharge fluid of the said auxiliary hydraulic pump 24 at its first pressure receiving portion 21*a*, assume to take the normally rotary position b.

This will cause a pressurized discharge fluid of the said primary hydraulic pump 20 to be supplied to a normal rotation port 22*a* of the said crusher purpose hydraulic motor 22, thus permitting the said swinging jaw 7 of the said crusher 3 to be reciprocated for crushing objects of crush to be crushed.

Here, when the said actuating switch 43 is operated to stop the electrical energization of the said first solenoid 25 and when the said switch 60 is turned on to electrically energize the said second solenoid 26, it can be seen that the said pilot valve 23 will be switched to take the reversely rotary position f which will in turn cause the pressurized discharge fluid of the said auxiliary hydraulic pump 24 to be delivered to a second pressure receiving portion 21*b* of the said crusher switching valve 21 to have it take its reversely rotary position c.

If this condition is established, it can be seen that the pressurized discharge fluid of the said primary hydraulic pump 20 will be delivered to the said crusher driving hydraulic motor 22 at its reverse rotation port 22*b* to cause this motor 22 to be reversely rotated, thus permitting the said swinging jaw 7 of the crusher 3 to be displaced by a short distance away from the said fixed jaw 6.

Accordingly, in a case where an object has been interlocked between the said fixed jaw 6 and the swinging jaw 7, the operation of the actuating switch 43 to terminate the electrical energization of the said first solenoid 25 and subsequently turning the said switch 60 on several times as mentioned previously will cause the said swinging jaw 7 to be moved by a short distance away from the said fixed jaw 6. Then, the interlocked object will be allowed to drop by its own gravity or can be removed with a small external force.

Figure 5:
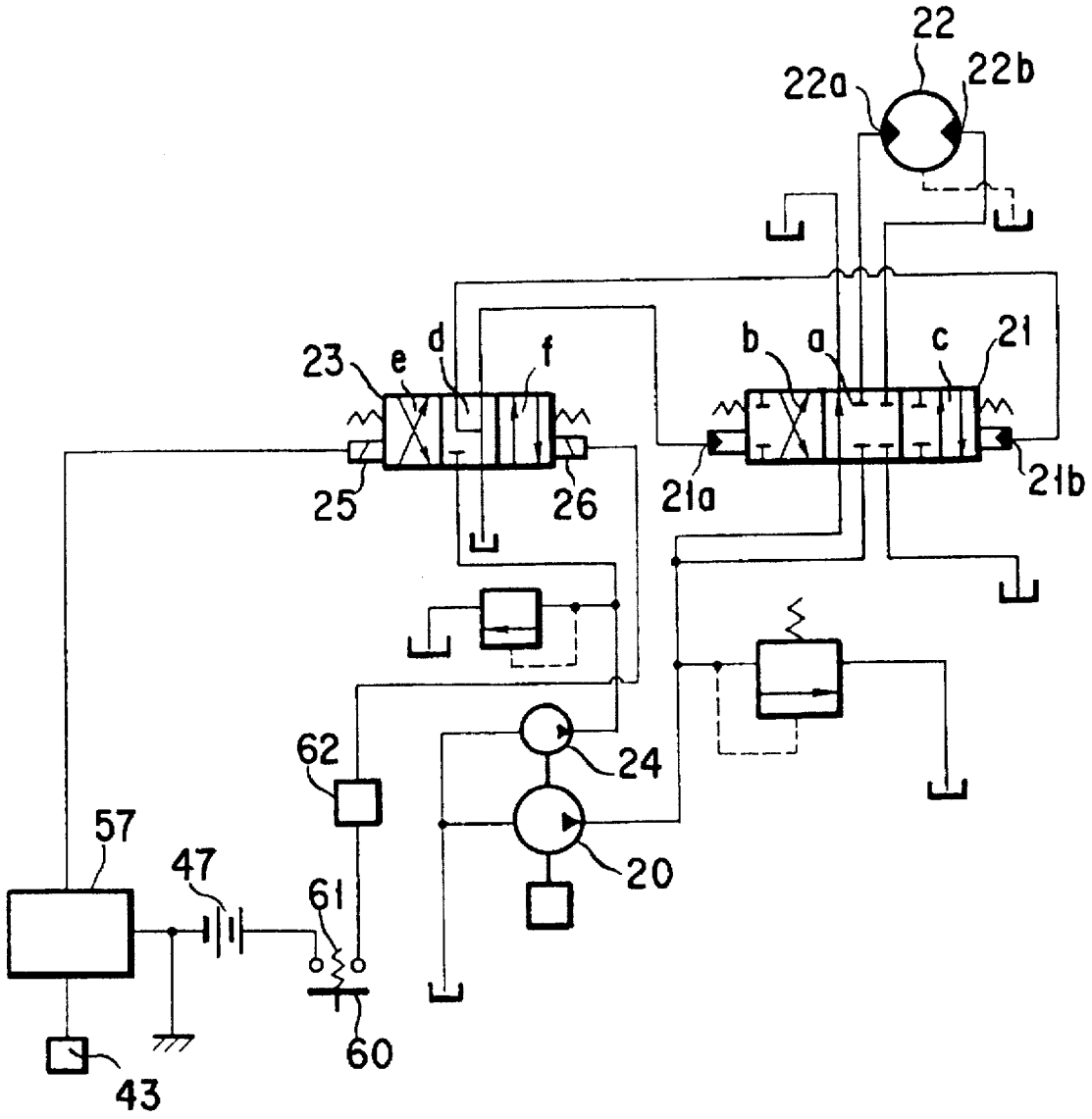
FIG. 5 is a circuit diagram illustrating still another crusher drive control hydraulic circuit for the above mentioned embodiment of the present invention.

FIG. 5 shows still another embodiment of the crusher drive control hydraulic circuit. In this embodiment, a timer 62 is shown as interposed between the said switch 60 and the said second solenoid 26. With this arrangement, since the said second solenoid 26 remains energized for a predetermined period of time after the said switch 60 is turned on, it can be seen that the said swinging jaw 7 will be displaced by a predetermined distance away from the said fixed jaw 6.

As set out above, according to the two preceding embodiments of the crusher drive control hydraulic circuit, it should be apparent that by virtue of the fact that since the said crusher driving hydraulic motor 22 is reversely rotated only while the switch 22 is actuated, setting the time of actuation of the said switch 22 at a short period of time will enable the said crusher driving hydraulic motor 22 to be rotated in a reverse direction for a limited distance and hence will enable the said swinging jaw 7 of the said crusher 3 to be displaced by a short distance away from the said fixed jaw 6, thereby permitting an interlocked object to be removed easily. Therefore, the removal of an interlocked object is never time consuming and hence a crushing operation is carried out most efficiently.

While the present invention has hereinbefore been described with respect to certain illustrative embodiments thereof, it will readily be appreciated by a person skilled in the art to be obvious that many alterations thereof, omissions therefrom and additions thereto can be made without departing from the essence and the scope of the present invention. Accordingly, it should be understood that the present invention is not limited to the specific embodiments thereof set out above, but includes all possible embodiments thereof that can be made within the scope with respect to the features specifically set forth in the appended claims and encompasses all equivalents thereof.

What is claimed is:

1. In a traveling type crushing machine including a vehicle body that is equipped with a traveling body and that has mounted thereon a crusher system including a feeder, a crusher and a belt conveyer;

the improvement wherein the crushing machine includes a crusher system control apparatus, comprising:

an abnormal condition detector for sensing an abnormal stoppage of said belt conveyer and outputting a detection signal responsive to sensing of an abnormal stoppage of said belt conveyer; and an operation terminating section which, in response to said detection signal that is output by said abnormal condition detector, stops operation of said feeder and said crusher.

2. The crusher system control apparatus for a traveling type crushing machine, as set forth in claim 1, comprising:

a feeder switching valve for delivering a pressure fluid to a feeder driving hydraulic motor driving said feeder;

a crusher switching valve for delivering a pressure fluid to a crushes driving hydraulic motor driving said crusher;

a belt conveyer switching valve for delivering a pressure fluid to a belt conveyer driving hydraulic motor driving said belt conveyer, wherein said abnormal condition detector comprises a pressure switch that is responsive to the delivered fluid pressure to said belt conveyer driving hydraulic motor that exceeds a predetermined pressure value; and said operation terminating section comprises an electric circuit that is responsive to a detection signal which is output by said pressure switch for driving each of said switching valves to a pressure fluid delivery stop position in which delivery of pressure fluid is stopped.

3. The crusher system control apparatus for a traveling type crushing machine, as set forth in claim 2, in which said electric circuit comprises:

a switch means that is connected to each of said switching valves and is responsive to an electrical signal furnished thereto for switching said each switching valve to one of a pressure fluid delivery position and said pressure fluid delivery stop position, a feeder relay connected to said switch means for said feeder switching valve, a feeder switch for driving said feeder relay, a crusher relay connected to said switch means for said crusher switching valve, a crusher switch for driving said crusher relay, a belt conveyer relay connected to said switch means for said belt conveyer switching valve, a belt conveyer switch for driving said belt conveyer relay, and an abnormal condition operative switch which is normally held ON and arranged in a circuit that connects a self hold contact of each of said relays with a power supply, whereby said detection signal from said pressure switch acts on said abnormal condition operative switch so as to turn it OFF.

4. The crusher system control apparatus for a traveling type crushing machine, as set forth in claim 3, further comprising:

an emergency stop switch connected in series with said abnormal condition operative switch in a circuit that connects said self-hold contact of said relay with said power supply.

5. The crusher system control apparatus for a traveling type crushing machine, as set forth in claim 3, in which each of said switch means for said feeder switching valve and said switch means for said belt conveyer switching valve comprises a solenoid, and said switch means for said crusher switching valve comprises a pilot valve that is adapted to be driven by a solenoid.

6. In a traveling type crushing machine including a vehicle body that is equipped with a traveling body and that has mounted thereon a crusher apparatus including a crusher and a belt conveyer, in which said crusher includes a fixed jaw and a movable jaw that is reciprocable towards and away from said fixed jaw by means of a hydraulic motor driving said crusher, a crusher-driving motor control system comprising a crusher switching valve for delivering a pressure fluid to said crusher driving hydraulic motor adapted to be switched from its neutral position alternatively to a normally rotary position and a reversely rotary position;

a pilot valve which is driven by a first solenoid and a second solenoid, respectively, coupled to said crusher switching valve; and a switch between a power supply and said second solenoid that is adapted to switch said pilot valve to a position to drive said crusher switching valve to said reversely rotary position.

7. The control system with a traveling type crushing machine, as set forth in claim 6, in which a timer is provided between said switch and said second solenoid.

8. In a traveling type crushing machine including a vehicle body that is equipped with a traveling body and that has mounted thereon a crusher system including a feeder, a crusher and a belt conveyer, in which said crusher includes a fixed jaw and a movable jaw that is reciprocable towards and away from said fixed jaw by means of a hydraulic motor driving said crusher, the improvement wherein the crushing machine includes a crusher system control apparatus, comprising:

an abnormal condition detector for sensing an abnormal stoppage of said belt conveyer and outputting a detection signal responsive to sensing of an abnormal stoppage of said belt conveyer;

an operation terminating section which, in response to said detection signal that is output by said abnormal condition detector, stops operation of each of said feeder and said crusher;

a crusher switching valve for delivering a pressure fluid to said crusher driving hydraulic motor, adapted to be switched from its neutral position alternatively to a normally rotary position and a reversely rotary position;

a pilot valve which is driven by a first solenoid and a second solenoid, respectively, coupled to said crusher switching valve; and a switch between a power supply and said second solenoid that is adapted to switch said pilot valve to a position to drive said crusher switching valve to said reversely rotary position.

9. The control apparatus in the traveling type crushing machine, as set forth in claim 8, said drive control apparatus further comprising:

a feeder switching valve for delivering a pressure fluid to a feeder driving hydraulic motor driving said feeder; and a belt conveyer switching valve for delivering a pressure fluid to a belt conveyer driving hydraulic motor driving said belt conveyer, in which said abnormal condition detector comprises a pressure switch that is responsive to the delivered fluid pressure to said belt conveyer driving hydraulic motor that exceeds a predetermined pressure value; and said operation terminating section comprises an electric circuit that is responsive to a detection signal which is output by said pressure switch for driving each of said switching valves to a pressure fluid delivery stop position in which delivery of pressure fluid is stopped.

10. The control apparatus in the traveling type crushing machine, as set forth in claim 9, in which said electric circuit comprises:

a switch means that is connected to each of said switching valves and is responsive to an electrical signal furnished thereto for switching said each switching valve to one of a pressure fluid delivery position and said pressure fluid delivery stop position, a feeder relay connected to said switch means for said feeder switching valve, a feeder switch for driving said feeder relay, a crusher relay connected to said switch means for said crusher switching valve, a crusher switch for driving said crusher relay, a belt conveyer relay connected to said switch means for said belt conveyer switching valve, a belt conveyer switch for driving said belt conveyer relay, and an abnormal condition operative switch which is normally held ON and arranged in a circuit that connects a self hold contact of each of said relays with a power supply, whereby said detection signal from said pressure switch acts on said abnormal condition operative switch so as to turn it OFF.

11. The control apparatus in the traveling type crushing machine, as set forth in claim 10, further comprising:

an emergency stop switch connected in series with said abnormal condition operative switch in a circuit that connects said self-hold contact of said relays with said power supply.

12. The control apparatus in the traveling type crushing machine, as set forth in claim 10, in which each of said switch means for said feeder switching valve and said switch means for said belt conveyer switching valve comprises a solenoid, and said switch means for said crusher switching valve comprises a pilot valve.

13. The control apparatus in the traveling type crushing machine, as set forth in claim 8, in which a timer is interposed between said switch and said second solenoid.

14. The crusher system control apparatus in the traveling type crushing machine, as set forth in claim 4, in which each of said switch means for said feeder switching valve and said switch means for said belt conveyer switching valve comprises a solenoid, and said switch means for said crusher switching valve comprises a pilot valve that is adapted to be driven by a solenoid.

15. The control apparatus in the traveling type crushing machine, as set forth in claim 11 in which each of said switch means for said feeder switching valve and said switch means for said belt conveyer switching valve comprises a solenoid, and said switch means for said crusher switching valve comprises a pilot valve.

* * * * *